US008204263B2

(12) United States Patent
Pedersen et al.

(10) Patent No.: US 8,204,263 B2
(45) Date of Patent: Jun. 19, 2012

(54) METHOD OF ESTIMATING WEIGHTING FUNCTION OF AUDIO SIGNALS IN A HEARING AID

(75) Inventors: Michael Syskind Pedersen, Smørum (DK); Ulrik Kjems, Smørum (DK); Karsten Bo Rasmussen, Smørum (DK); Thomas Bo Elmedyb, Smørum (DK); Jesper Bünsow Boldt, Smørum (DK)

(73) Assignee: Oticon A/S, Smorum (DK)

( * ) Notice: Subject to any disclaimer, the term of this patent is extended or adjusted under 35 U.S.C. 154(b) by 978 days.

(21) Appl. No.: 12/222,810

(22) Filed: Aug. 15, 2008

(65) Prior Publication Data

US 2009/0202091 A1 Aug. 13, 2009

(30) Foreign Application Priority Data

Feb. 7, 2008 (EP) ..... 08101366

(51) Int. Cl.
*H04R 25/00* (2006.01)

(52) U.S. Cl. ..... 381/313; 381/323; 381/328; 381/330

(58) Field of Classification Search ..... None
See application file for complete search history.

(56) References Cited

U.S. PATENT DOCUMENTS

| | | | | |
|---|---|---|---|---|
| 5,721,783 | A * | 2/1998 | Anderson | 381/328 |
| 5,751,817 | A | 5/1998 | Brungart | |
| 6,424,721 | B1 * | 7/2002 | Hohn | 381/313 |
| 2003/0169891 | A1 * | 9/2003 | Ryan et al. | 381/92 |
| 2005/0041824 | A1 | 2/2005 | Arndt et al. | |
| 2005/0058312 | A1 | 3/2005 | Weidner | |
| 2007/0274550 | A1 * | 11/2007 | Baechler et al. | 381/315 |

FOREIGN PATENT DOCUMENTS

| | | | |
|---|---|---|---|
| EP | 1 414 268 | A2 | 4/2004 |
| EP | 1 443 798 | A2 | 8/2004 |
| WO | WO-99/09786 | A1 | 2/1999 |
| WO | WO-2006/136615 | A2 | 12/2006 |

* cited by examiner

*Primary Examiner* — Hoang-Quan Ho
(74) *Attorney, Agent, or Firm* — Birch, Stewart, Kolasch & Birch, LLP

(57) ABSTRACT

Disclosed is method of generating an audible signal in a hearing aid by estimating a weighting function of received audio signals, the hearing aid is adapted to be worn by a user; the method comprises the steps of:

estimating a directional signal by estimating a weighted sum of two or more microphone signals from two or more microphones, where a first microphone of the two or more microphones is a front microphone, and where a second microphone of the two or more microphones is a rear microphone;

estimating a direction-dependent time-frequency gain, and synthesizing an output signal;

wherein estimating the direction-dependent time-frequency gain comprises:

obtaining at least two directional signals each containing a time-frequency representation of a target signal and a noise signal; and where a first of the directional signals is defined as a front aiming signal, and where a second of the directional signals is defined as a rear aiming signal;

using the time-frequency representation of the target signal and the noise signal to estimate a time-frequency mask; and using the estimated time-frequency mask to estimate the direction-dependent time-frequency gain.

41 Claims, 7 Drawing Sheets

METHOD OF ESTIMATING WEIGHTING FUNCTION OF AUDIO SIGNALS IN A HEARING AID

FIELD OF THE INVENTION

This invention generally relates to generating an audible signal in a hearing aid. More particularly, the invention relates to a method of estimating and applying a weighting function to audio signals.

BACKGROUND OF THE INVENTION

Sound signals arriving frontally at the ear are accentuated due to the shape of the pinna, which is the external portion of the ear. This effect is called directionality, and for the listener it improves the signal-to-noise ratio for sound signals arriving from the front direction compared to sound signals arriving from behind. Furthermore, the reflections from the pinna enhance the listener's ability to localize sounds. Sound localization may enhance speech intelligibility, which is important for distinguishing different sound signals such as speech signals, when sound signals from more than one direction in space are present. Localization cues used by the brain to localize sounds can be related to frequency dependent time and level differences of the sound signals entering the ear as well as reflections due to the shape of the pinna. E.g. at low frequencies, localization of sound is primarily determined by means of the interaural time difference.

For hearing aid users good sound localization and speech intelligibility may often be harder to obtain.

In some hearing aids, e.g. behind-the-ear (BTE) hearing aids, the hearing aid microphone is placed behind the external portion of the ear and therefore sound signals coming from behind and from the sides are not attenuated by the pinna. This is an unnatural sensation for the hearing aid user, because the shape of the pinna would normally only accentuate sound signals coming frontally.

Thus, a hearing aid user's ability to localize sound decreases as the hearing aid microphone is placed further away from the ear canal and thereby the eardrum. Thus sound localization may be degraded in BTE hearing aids compared to hearing aids such as in-the-ear (ITE) or completely-in-the-canal (CIC) hearing aids, where the microphone is placed closer to or in the ear canal.

In order to obtain an improved directionality, a directional microphone can be incorporated in hearing aids, e.g. in BTE hearing aids. The directional microphone can be more sensitive towards the sound signals arriving frontally in the ear of the hearing aid user and may therefore reproduce the natural function of the external portion of the ear, and a directional microphone therefore allows the hearing aid user to focus hearing primarily in the direction the user's head is facing. The directional microphone allows the hearing aid user to focus on whoever is directly in front of him/her and at the same time reducing the interference from sound signals, such as conversations, coming from the sides and from behind. A directional microphone can therefore be very useful in crowded places, where there are many sound signals coming from many directions, and when the hearing aid user wishes only to hear one person talking.

A directionality pattern or beamforming pattern may be obtained from at least two omni-directional microphones or at least one directional microphone in order to perform signal processing of the incoming sound signals in the hearing aid.

EP1414268 relates to the use of an ITE microphone to estimate a transfer function between ITE microphone and other microphones in order to correct the misplacement of the other microphones and in order to estimate the arrival direction of impinging signals.

US2005/0058312 relates to different ways to combine tree or more microphones in order to obtain directionality and reduce microphone noise. US2005/0041824 relates to level dependent choice of directionality pattern. A second order directionality pattern provides better directionality than a first order directionality pattern, but a disadvantage is more microphone noise. However, at high sound levels, this noise will be masked by the sound entering the hearing aid from the sides, and thus a choice between first and second order directionality can be made based on the sound level.

EP1005783 relates to estimating a direction-based time-frequency gain by comparing different beamformer patterns. The time delay between two microphones can be used to determine a frequency weighting (filtering) of an audio signal. EP1005783 describes using the comparison between a directional signal obtained from at least 2 microphone signals with the amplitude of one of the microphone signals.

"Binaural segregation in multisource reverberant environments" by N. Roman et al. describes a method of estimation a time-frequency mask by using a binaural segregation system that extracts the reverberant target signal from multisource reverberant mixtures by utilising only the location information of the target source.

"Enhanced microphone-array beamforming based on frequency-domain spatial analysis-synthesis" by M. M. Goodwin describes a delay-and-sum beamforming system in relation to distant-talking hands-free communication, where reverberation and interference from unwanted sound sources is hindering. The system improves the spatial selectivity by forming multiple steered beams and carrying out a spatial analysis of the acoustic scene. The analysis derives a time-frequency gain that, when applied to a reference look-direction beam, enhances target sources and improves rejection of interferers that are outside of the specified target region.

However, even though different prior art documents describe methods of how to improve sound localization in hearing aids, alternative methods of generating an audible signal in a hearing aid which may improve sound localization and speech intelligibility for the hearing aid user may be provided.

SUMMARY

Disclosed is a method generating an audible signal in a hearing aid by estimating a weighting function of received audio signals, the hearing aid is adapted to be worn by a user; the method comprises the steps of:

estimating a directional signal by estimating a weighted sum of two or more microphone signals from two or more microphones, where a first microphone of the two or more microphones is a front microphone, and where a second microphone of the two or more microphones is a rear microphone;

estimating a direction-dependent time-frequency gain, and synthesizing an output signal;

wherein estimating the direction-dependent time-frequency gain comprises:

obtaining at least two directional signals each containing a time-frequency representation of a target signal and a noise signal; and where a first of the directional signals is defined as a front aiming signal, and where a second of the directional signals is defined as a rear aiming signal;

using the time-frequency representation of the target signal and the noise signal to estimate a time-frequency mask; and using the estimated time-frequency mask to estimate the direction-dependent time-frequency gain.

Consequently, it is an advantage that the direction-dependent time-frequency gain is estimated by comparing two directional signals with each other, because the ratio between the power of the envelopes of the two directional signals is maximized, since one of the directional signals in the direction of the target signal aims at cancelling the noise sources, and the other directional signal aims at cancelling out the target source, while the noise sources are maintained. Thus, the target and the noise/interferer signals are separated very well and by maximizing the ratio between the front and the rear aiming directional signals, it is easier to control the weighting function, and thereby the sound localization and the speech intelligibility of the target speaker may be improved for the hearing aid user.

If for instance a directional signal and an omnidirectional signal were compared, the difference between these two signals will not be as big as the difference between two directional signals, and it would therefore be more difficult to separate the target signal and the noise/interferer signal, when using an omnidirectional signal and a directional signal. Directional signals estimated from microphone differences result in a high-pass filtered signal. Thus a low-pass post-filtering of the directional signal is necessary to compensate for this high-pass filtering. However, an advantage of comparing two directional signals, contrary to comparing a directional signal to an omni-directional, is that the post-filtering of the directional signals can be avoided. The hearing aid user may, for example, want to focus on listening to one person speaking, while there are noise signals or signals which interfere at the same time. By providing two microphones, such as a front and a rear microphone, in the hearing aid, the hearing aid user may turn his head in the direction from where the desired target source is coming from.

The front microphone in the hearing aid may pick up the desired audio signals from the target source, and the rear microphone in the hearing aid may pick up the undesired audio signals not coming from the target source. However, audio signals will typically be mixed, and the problem will then be to decide what contribution to the incoming signal is made from which sources.

It is an advantage of the present invention that this decision is performed by means of providing time-frequency representations of the target signal and the noise signal so that the two directional signals can be compared with each other for each time-frequency coefficient, because thereby it can be determined for each time-frequency coefficient whether the time-frequency coefficient is related to the target signal or the noise signal, and this enables the estimation of the direction-dependent time-frequency mask. Time-frequency representations may be complex-valued fields over time and frequency, where the absolute value of the field represents "energy density" (the concentration of the root mean square over time and frequency) or amplitude, and the argument of the field represents phase. Thus the time-frequency coefficients represent the energy of the signal.

The time-frequency mask may be estimated in the hearing aid, which the user wears. Alternatively, the time-frequency mask may be estimated in a device arranged externally relative to the hearing aid and located near the hearing aid user. It is an advantage that the estimated time-frequency mask may still be used in the hearing aid even though it may be estimated in an external device, because the hearing aid and the external device may communicate with each other by means of a wired or wireless connection.

In one embodiment using the time-frequency representation of the target signal and the noise signal to estimate a time-frequency mask comprises comparing the at least two directional signals with each other for each time-frequency coefficient in the time-frequency representation.

In one embodiment using the estimated time-frequency mask to estimate the direction-dependent time-frequency gain comprises determining, based on said comparison, for each time-frequency coefficient, whether the time-frequency coefficient is related to the target signal or the noise signal.

In one embodiment the method further comprises:

obtaining an envelope for each time-frequency representation of the at least two directional signals;

using the envelope of the time-frequency representation of the target signal and the noise signal to estimate the time-frequency mask.

In one embodiment the method further comprises using the envelope of the time-frequency representation of the target signal and the noise signal to estimate a time-frequency mask comprises comparing the two envelopes of the directional signals with each other for each time-frequency envelope sample value.

In one embodiment the method further comprises determining the envelope of a time-frequency representation comprising:

raising the absolute magnitude value of each time-frequency coefficient to the p'th power, where p is a predetermined value;

filtering the power raised absolute magnitude value over time by using a predetermined low pass filter.

In one embodiment, determining for each time-frequency coefficient whether the time-frequency coefficient is related to the target signal or the noise signal comprises: determining the envelope of the time-frequency representation of the directional signals, determining the ratio of the power of the envelope of the directional signal in the direction of the target signal, i.e. the front direction, to the power of envelope of the directional signal in the direction of the noise signal, i.e. the rear direction; and assigning the time-frequency coefficient as relating to the target signal if this ratio exceeds a given threshold; and assigning the time-frequency coefficient as relating to the noise signal otherwise. This threshold is typically implemented as a relative power threshold, i.e. in units of dB. An envelope could e.g. be the power of the absolute magnitude value of each time-frequency coefficient.

An advantage of this embodiment is that if the directional signal in the direction of the target signal for a given threshold exceeds the directional signal in the direction of the noise signal for a time-frequency coefficient, then this time-frequency coefficient is labelled as belonging to the target signal, and this time-frequency coefficient will be retained. If the directional signal in the direction of the noise signal exceeds the directional signal in the direction of the target signal for a time-frequency coefficient, then this time-frequency coefficient is labelled as belonging to the noise/interferer signal, and this time-frequency coefficient will be removed.

In one embodiment the direction-dependent time-frequency mask is binary, and the direction-dependent time-frequency mask is 1 for time-frequency coefficients belonging to the target signal, and 0 for time-frequency coefficients belonging to the noise signal.

The pattern of assignments of time-frequency units as either belonging to the target or the noise signal may be termed a binary mask. It is an advantage of this embodiment that the direction-dependent time-frequency mask is binary, because it makes it possible to perform and simplify the assignment of the time-frequency coefficients as either belonging to the target source or to a noise/interferer source. Hence, it allows a simple binary gain assignment, which may improve speech intelligibility for the hearing aid user, when applying the gain to the signal which is presented to the listener.

When constructing the binary mask, a criterion for defining the amount of target and noise/interferer signals must be applied. This criterion controls the number of retained and removed time-frequency coefficients. A "0 dB signal-to-noise ratio" (SNR) may be used, meaning that a time-frequency coefficient is labelled as belonging to the target signal, if the power of the target signal envelope is exactly larger than the noise/interferer signal envelope. However, a criterion different from the "0 dB SNR" may also provide the same major improvement in speech intelligibility for the hearing aid user. E.g. a criterion of 3 dB means that the level of the target has to be 3 dB higher than the noise.

A time-frequency gain estimated from the time-frequency mask can be multiplied to the directional signal. Hereby an enhancement on top of the directional signal can be achieved. However, at low frequencies, it can be advantageous to multiply the time-frequency gain to one of the microphone signals or to the sum of the two microphone signals since the directional signal contains more noise at the low frequencies due to the low-pass post-filtering, which may be necessary.

Low frequencies may be frequencies below 200 Hz, 300 Hz, 400 Hz, 500 Hz, 600 Hz or the like.

The time-frequency mask may be binary, but other forms of masks may also be provided. However, when providing a binary mask, interpretation and/or decision about what 0 and 1 mean may be performed. 0 and 1 may be converted to a level measured in dB, such as a level enhancement, e.g. in relation to a level measured previously.

In one embodiment the method further comprises multiplying the estimated direction-dependent time-frequency gain to a directional signal and processing and transmitting the output signal to the output transducer in the hearing aid at low frequencies.

It is an advantage of this embodiment that the direction-dependent time-frequency gain is multiplied to a directional signal, since applying the direction-dependent time-frequency gain will improve the directionality.

The time-frequency mask mainly relies on the time difference between the microphones. Whether the mask is estimated near the ear or a little further away, such as behind the ear, does not have much influence on the areas in time and in frequency where the noise signal or target signal dominates. Therefore, the directional signals from the two microphones, which are arranged in a behind the ear part of the hearing aid, can be used when estimating the weighting function, and audio signals may be processed in the hearing aid based on this. The time-frequency mask may still be used in the hearing aid even though it may be estimated in an external device arranged relative to the hearing aid and located near the hearing aid user.

At low frequencies, localization of sounds is primarily determined by means of the interaural time difference, and at low frequencies the interaural time difference does not depend much on where by the ear the microphones are placed.

Additionally, an alignment as regards time of the gain and the signal, to which the gain is applied, may be provided. E.g. the signal may be delayed in relation to the gain in order to obtain the temporal alignment. Furthermore, smoothing, i.e. low pass filtering, of the gain may be provided.

In some embodiments it may be sufficient to process and transmit a directional signal to the output transducer in the hearing aid at low frequencies, but the directionality will be further improved by multiplying the direction-dependent time-frequency gain to the directional signal.

In one embodiment the method further comprises multiplying the estimated direction-dependent time-frequency gain to a signal from one or more of the microphones, and processing and transmitting the output signal to the output transducer in the hearing aid at low frequencies.

In one embodiment the method further comprises applying the estimated direction-dependent time-frequency gain to a signal from a third microphone, the third microphone being arranged near or in the ear canal, and processing and transmitting the output signal to the output transducer in the hearing aid at high frequencies.

An advantage of this embodiment is that the direction-dependent time-frequency gain is applied to a third microphone arranged near or in the ear canal, because at higher frequencies, the location of the microphone is important for the sound localization. At high frequencies, localization cues is maintained by using a microphone near or in the ear canal, because the microphone is thus placed close to the ear drum, which improves the hearing aid user's ability to localize sounds.

The hearing aid may comprise three microphones. Two microphones may be located behind the ear, e.g. such as in a behind-the-ear hearing aid. The third microphone is located much closer to the ear canal, e.g. such as an in-the-ear hearing aid, than the two other microphones. Thus, it is an advantage of this embodiment that it is possible to obtain directional amplification by means of the microphones behind the ear and still preserve good localization by having the possibility to process sound near or in the ear canal and thus close to the ear drum by means of the third microphone arranged near or in the ear canal.

Alternatively, the two microphones used for estimating the gain may be arranged in a device arranged externally in relation to the hearing aid and the third microphone.

It is an advantage that sound localization and speech intelligibility may be improved for the hearing aid user due to the use of three microphones.

A further advantage of this embodiment is that because the two microphones are the microphones used in estimating the weighting function, only microphone matching between these two microphones should be performed, which simplifies the signal processing.

In some embodiments it may be sufficient to process and transmit only the signal from the third microphone arranged near or in the ear canal to the output transducer in the hearing aid at high frequencies, but the directionality will be further improved by multiplying the direction-dependent time-frequency gain to the signal from the third microphone.

By estimating a direction-dependent gain pattern in time and in frequency using the microphones located behind the ear or located in an external device and applying this gain to the third microphone located in or near the ear canal, there is no need for a correction filter in the hearing aid to correct for location mismatch, because the third microphone ensures that the localization cues will be maintained.

Furthermore, it may be possible to use different sampling frequencies and bandwidths for the microphones behind the ear or in the external device compared to the microphone near or in the ear canal, and computational power can thus be saved. All automatics may as well be run with a lower sampling rate.

The direction-dependent time-frequency gain may be applied to the third microphone for all frequencies or for the higher frequencies in order to enhance directionality, while the direction-dependent time-frequency gain for the low frequencies may be applied to the directional signal from the microphones behind the ear or in the external device.

The third microphone may be a microphone near or in the ear canal, e.g. an in-the-ear microphone, or the like.

In one embodiment the method further comprises applying the estimated direction-dependent time-frequency gain to one or more of the microphone signals from one or more of the microphones, and processing and transmitting the output signal to the output transducer in the hearing aid.

It is an advantage to apply the direction-dependent time-frequency gain to one or more signals from the microphones for all frequencies, both high and low frequencies, since this may improve the audible signal generated in the hearing aid.

In one embodiment the directional signals are provided by means of at least two beamformers, where at least one of the beamformers is chosen from the group consisting of:

fixed beamformers adaptive beamformers.

An advantage of this embodiment is that beamformers separate target signals and noise signals in space and exploit this to improve the SNR by employing microphones and signals processing to amplify the signals from the target direction.

An advantage of the adaptive beamformer is that an adaptive beamformer is able to adapt automatically its response to different situations, and this typically improves rejection of unwanted signals from other directions. It is therefore possible to achieve good noise reduction from an adaptive beamformer.

An advantage of the fixed beamformer is that fixed beamformers combine the signals from the microphones by mainly using only information about the location of the microphones in space and the signal directions of interest, and this enables the hearing aid user to have more and/or better control over the system.

Furthermore, by using two microphones it may be possible to create different sets of beam patterns.

In one embodiment the estimated time-frequency gain is applied to a directional signal, where the directional signal aims at attenuating signals in the direction, where the ratio between the transfer function of the front beamformer and the transfer function of the rear beamformer equals the decision threshold, i.e. that is in the direction of the decision boundary between the front-aiming and the rear-aiming beamformer.

In the directions, where the decision boundary between the two directional signals is located, the time-frequency mask estimate is based on a weak decision. In order to minimize the effect of weak decisions, it is an advantage to multiply the resulting time-frequency gain to a directional signal, which aims at attenuating signals in the direction of the weak decision.

In one embodiment the method further comprises transmitting and interchanging the direction-dependent time-frequency masks between two hearing aids, when the user is wearing one hearing aid on each ear. When the user is wearing two hearing aids, two time-frequency masks may be provided. The estimated time-frequency gains from these masks may be transmitted from one of the hearing aids to the other hearing aid and vice versa. The direction-dependent time-frequency gains measured in the two hearing aids may differ from each other due to microphone noise, microphone mismatch, head-shadow effects etc, and consequently an advantage of this embodiment is that a joint binary mask estimation is more robust towards noise. So by interchanging the binary direction-dependent time-frequency masks between the two ears a better estimate of the binary gain may be obtained.

A further advantage is that by synchronizing the binary gain pattern on both ears, the localization cues are less disturbed, as they would have been with different gain patterns on both ears.

Furthermore, only the binary mask values have to be transmitted between the ears, and not the entire gains or audio signals, which simplify the interchanging and synchronization of the direction-dependent time-frequency gains.

In one embodiment the method further comprises performing parallel comparisons of the difference between the target signal and the noise signal and merging the parallel comparisons between sets of different beam patterns.

An advantage of this embodiment is that when making several comparisons in parallel instead of just one comparison, the most robust estimate will be made, since each comparison has a direction in which the estimate is more robust than in other directions. Towards the directions with the biggest difference between the front and the rear signals the time-frequency mask estimates may be very good and robust.

These comparisons between different directional signals and merging and/or combining the parallel comparisons may be performed in one hearing aid and/or in two hearing aids, if the user is wearing a hearing aid at both ears.

In one embodiment the merging comprises applying functions between the different time-frequency masks, at least one of the functions is chosen from the group consisting of:

AND functions

OR functions psychoacoustic models.

An advantage of this embodiment is that by applying functions such as OR, AND and/or psychoacoustic model to the different estimates, an overall more robust binary gain estimate can be obtained. As an example, a time-frequency mask provided by one of the two hearing aids may e.g. be used for both hearing aids, and thus the mask provided by the other of the two hearing aids may thus be disregarded. Whether an OR or AND function is used depends on the chosen comparison threshold.

The present invention relates to different aspects including the method described above and in the following, and corresponding methods, devices, and/or product means, each yielding one or more of the benefits and advantages described in connection with the first mentioned aspect, and each having one or more embodiments corresponding to the embodiments described in connection with the first mentioned aspect and/or disclosed in the appended claims.

According to one aspect a hearing aid adapted to be worn by a user is disclosed, the hearing aid comprises one or more microphones, a signal processing unit, and one or more output transducers, wherein a first module comprises at least one of the one or more microphones.

In one embodiment a device adapted to be arranged externally in relation to one or more hearing aids, where the device comprises processing means adapted to perform an estimation of one or more time-frequency masks, and wherein the one or more time-frequency masks are transmitted to the one or more hearing aids.

It is an advantage to use an external device for estimating time-frequency masks and then transmitting the masks to the hearing aid(s), since thereby a hearing aid may only require one microphone. The external device may be a hand-held device.

The features of the method described above may be implemented in software and carried out on a data processing system or other processing means caused by the execution of computer-executable instructions. The instructions may be program code means loaded in a memory, such as a RAM, from a storage medium or from another computer via a computer network. Alternatively, the described features may be implemented by hardwired circuitry instead of software or in combination with software.

According to another aspect a computer program comprising program code means for causing a data processing system to perform the method is disclosed, when said computer program is executed on the data processing system.

According to a further aspect a data processing system comprising program code means for causing the data processing system to perform the method is disclosed.

BRIEF DESCRIPTION OF THE DRAWINGS

The above and/or additional objects, features and advantages of the present invention, will be further elucidated by the following illustrative and non-limiting detailed description of embodiments of the present invention, with reference to the appended drawings, wherein.

DETAILED DESCRIPTION

In the following description, reference is made to the accompanying figures, which show by way of illustration how the invention may be practiced.

Figure 1B:
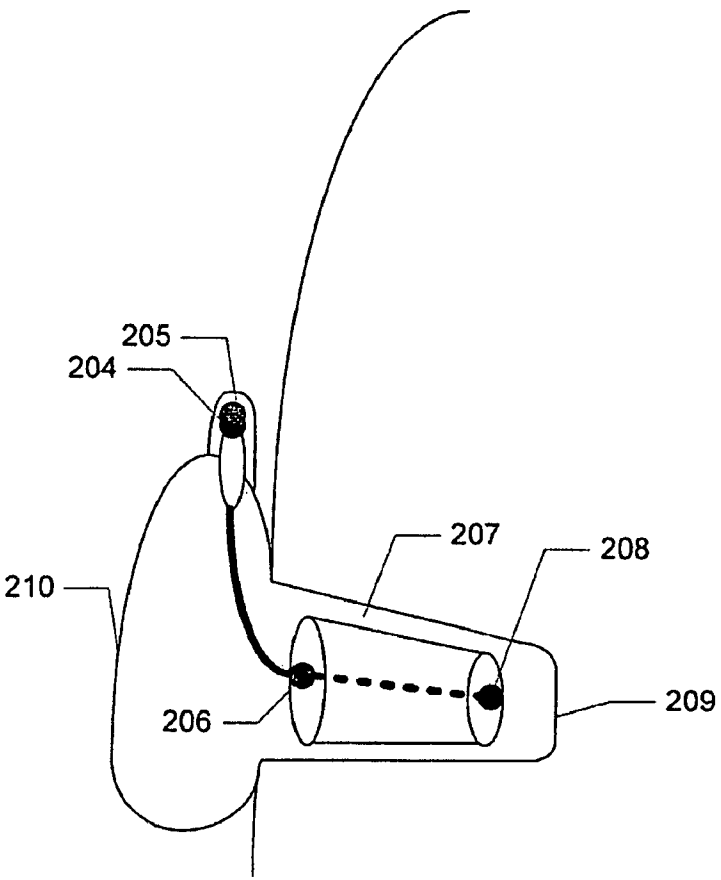
FIG. 1 shows a schematic view of a hearing aid user wearing a hearing aid.
Figure 1A:
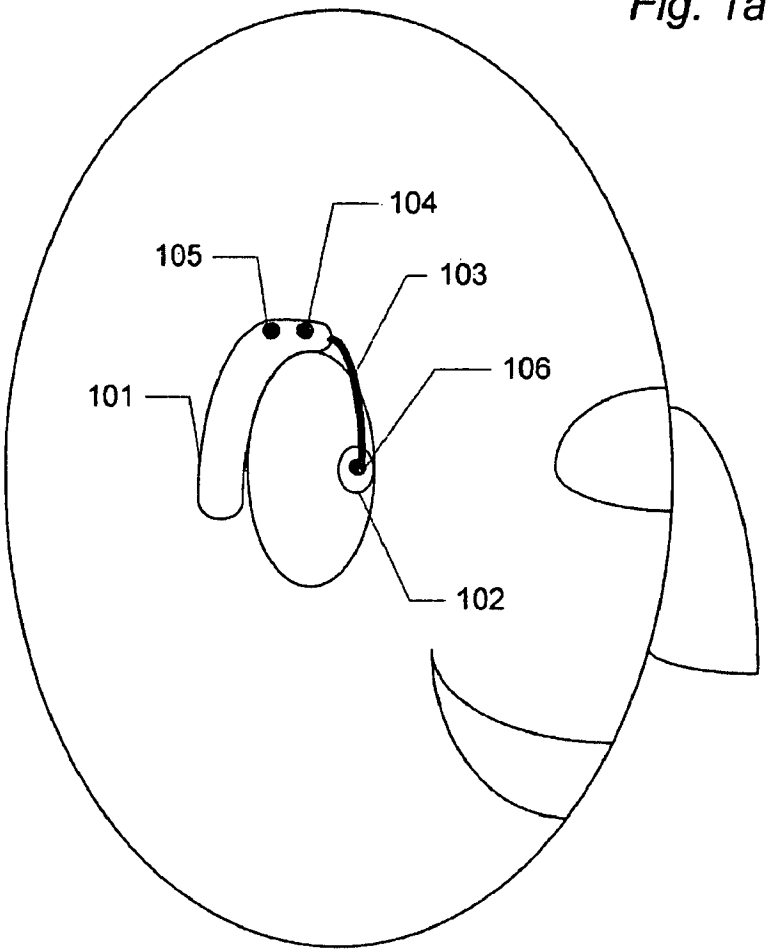

FIG. 1*a* shows a schematic view of a hearing aid user wearing a hearing aid with a number of input transducers, such as microphones. The hearing aid is shown to comprise a part away from the ear, such as a behind-the-ear (BTE) shell or part 101 and part near or in the ear canal, such as an in-the-ear (ITE) part 102. In the following the part near or in the ear canal will be referred to as an ITE part, but it is understood that the part arranged near or in the ear canal is not limited to an ITE part, but may be any kind of part arranged near or in the ear canal. Furthermore, in the following, the part arranged away from or behind the ear will be referred to as a BTE part, but it is understood that the part arranged away from or behind the ear is not limited to a BTE part, but it may be any kind of part arranged away from or behind the ear. The two parts may be connected by means of a wire 103. The BTE part 101 may comprise two input transducers 104, 105, which may be arranged as a front microphone and a rear microphone, respectively, and the ITE part 102 may comprise one input transducer 106, such as a microphone.

FIG. 1*b* shows a more detailed view of a hearing aid with three input transducers, e.g. microphones. Two of the input transducers 204 and 205, e.g. microphones, may be arranged as a front and a rear microphone in the BTE shell behind the ear or pinna 210 of a user as in a conventional BTE hearing aid. A third input transducer 206, e.g. a microphone, may be arranged as an ITE microphone in an ear mould 207, such as a so called micro mould, which may be connected to the BTE shell by means of e.g. a small wire 203. The connection between the BTE shell and the ear mould may be conducted by other means, such as wireless connection, such as radio frequency communication, microwave communication, infrared communication, and/or the like.

Figure 2:
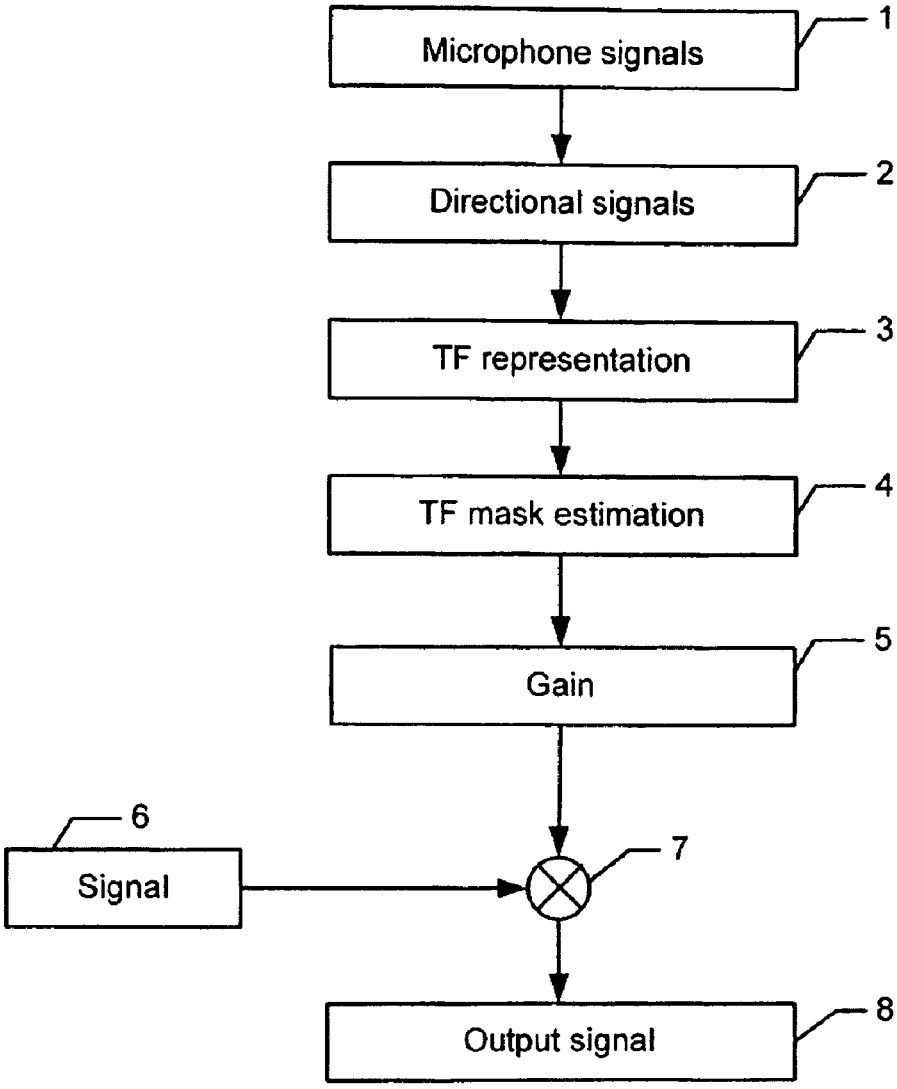
FIG. 2 shows a flowchart of a method of generating an audible signal in a hearing aid.

An output transducer 208, e.g. a receiver or loudspeaker, may be comprised in the ear mould part 207 in order to transmit incoming sounds close to the eardrum 209. Even though only one output transducer is shown in FIG. 2, the hearing aid may comprise more than one output transducer. Alternatively, the hearing aid may only comprise two BTE microphones and no ITE microphone. Alternatively and/or additionally, the hearing may comprise more than two BTE microphones and/or more than one ITE microphone. A signal processing unit may be comprised in the ear mould part in order to process the received audio signals. Alternatively or additionally, a signal processing unit may be comprised in the BTE shell.

The sound presented to the hearing aid user may be a mixture of the signals from the three input transducers.

The input transducers in the BTE hearing aid part may be omnidirectional microphones. Alternatively, the BTE input transducers may be any kind of microphone array providing a directional hearing aid, i.e. by providing directional signals.

The part near or in the ear canal may be referred to as the second module in the following. The microphone in the second module may be an omni-directional microphone or a directional microphone.

The part behind the ear may comprise the signal processing unit and the battery in order to save space in the part near or in the ear canal.

The second module adapted to be arranged at the ear canal may be an ear insert, a plastic insert and/or it may be shaped relative to the user's ear.

Furthermore, the second module may comprise a soft-material. The soft material may have a shape as a dome, a tip, a cap and/or the like.

Additionally, the hearing aid may comprise communications means for communicating with a second hearing aid arranged at another ear of the user.

FIG. 2 shows a flowchart of a method of generating an audible signal in a hearing aid.

In step 1, two or more microphone signals are obtained from at least two microphones.

In step 2, directional signals are estimated by estimating a weighted sum of the two or more microphone signals from the at least two microphones in the hearing aid.

In step 3, a time-frequency representation of each the directional signals is obtained.

In step 4, a time-frequency mask is estimated based on the time-frequency representation of the directional signals.

In step 5, a time-frequency gain is estimated based on the time-frequency mask.

In step 6, a signal from one or more of the microphones is provided. The signal may be a combination of more microphone signals.

In step 7, the time-frequency gain is applied to the signal from the one or more microphones.

In step 8, an output signal is generated and provided in an output transducer in the hearing aid.

Furthermore, additional steps may be provided for generating an audible signal in the hearing aid. In one embodiment, a microphone matching system may be provided between step 1 and 2. In one embodiment, a post-processing of the directional signals may be provided, before the time-frequency mask is estimated in step 4. In one embodiment, a post-processing of the time-frequency mask may be provided, before the gain is estimated in step 5.

Figure 3:
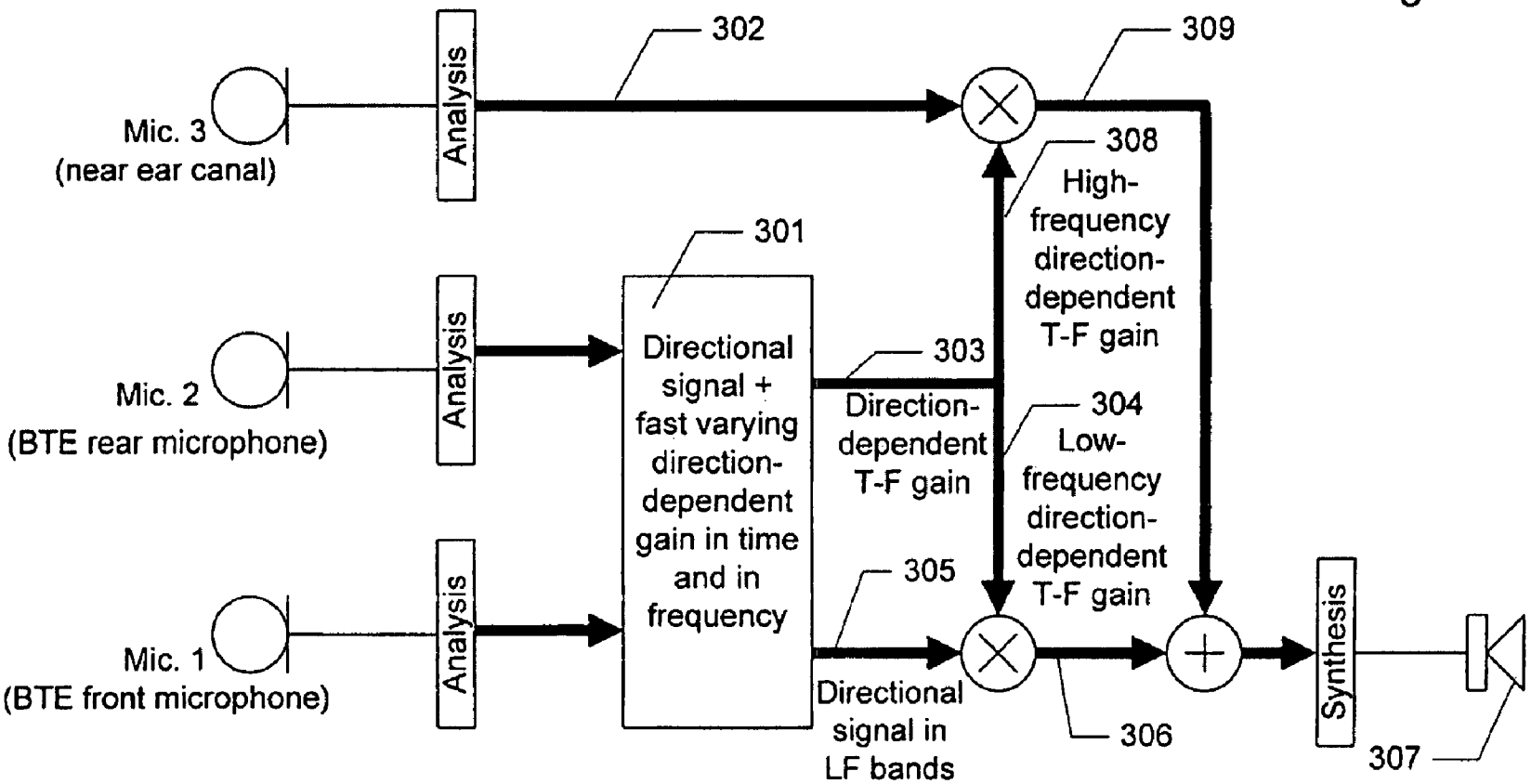
FIG. 3 shows analysis, processing and combination of signals in a hearing aid.

FIG. 3 shows how the signals from the three input transducers may be analysed, processed and combined before being transmitted to the output transducer. A weighting function of the signals may be estimated in order to improve sound localization and thereby speech intelligibility for the hearing aid user. A directional signal and a time-frequency direction-dependent gain can be estimated 301 from the two BTE microphones (mic 1 and mic 2), and a signal from the ITE microphone (mic. 3) can be obtained 302. The direction-dependent gain 303, calculated from the signals from the two BTE microphones, is fast-varying in time and frequency, and it may be binary. Reference to how a directional signal can be calculated is found in "Directional Patterns Obtained from Two or Three Microphones" by Stephen C. Thompson, Knowles Electronics, 2000.

These signals may be combined in different ways depending on the frequency, and the estimation of the weighting function may thus depend on whether the frequency is high or low. However, the processed high- and low-frequency signals may be added and synthesized before being transmitted to the output transducer.

At low frequencies 304 the estimated direction-dependent time-frequency gain may be multiplied to a directional signal 305 from the BTE microphones and the output signal 306 may be processed and transmitted to the output transducer in the hearing aid 307. By multiplying the direction-dependent time-frequency gain to the directional signal, the directionality can be improved.

Since localization of sounds is primarily determined by means of the interaural time difference at low frequencies, and the interaural time difference does not depend much on where by the ear the microphones are placed at low frequencies, the audio signals from the BTE microphones may be transmitted in the hearing aid at low frequencies.

The combination of the microphone signals from the BTE microphones may be a directional sound signal or an omnidirectional sound signal.

Furthermore, a sum of the two microphone signals may provide a better signal-to-noise ratio than e.g. a difference between the microphone signals.

In some embodiments it may be sufficient to process and transmit a directional signal from the BTE microphones to the output transducer in the hearing aid at low frequencies, without multiplying the direction-dependent time-frequency gain 303 to the directional signal 305, whereby the low frequency part of the directional signal may be a weighted sum of the two BTE microphone signals. However, the directionality may be further improved by multiplying the direction-dependent time-frequency gain to the directional signal.

When processing the signals, microphone matching between the two BTE microphones should be performed, but the matching may be relatively simply because there are only two microphones to take into account.

At high frequencies 308, the estimated direction-dependent time-frequency gain may be applied to the signal 302 from the third microphone, the ITE microphone, and the output signal 309 may be processed and transmitted to the output transducer 307 in the hearing aid.

At high frequencies, the location of the microphone is important for the sound localization, and at high frequencies, localization cues are better maintained by using an ITE microphone, because the microphone is thus placed closer to the ear drum, which improves the hearing aid user's ability to localize sounds.

It is therefore possible to obtain directional amplification by means of the BTE microphones and still preserve binaural listening by processing sound signals very close to or in the ear canal close to the ear drum by means of the ITE microphone.

In some embodiments it may be sufficient to process and transmit the signal 302 from the ITE microphone to the output transducer 307 in the hearing aid at high frequencies, without multiplying the direction-dependent time-frequency gain to the ITE microphone signal 302, but the directionality may be further improved by multiplying the direction-dependent time-frequency gain to the signal from the ITE microphone at high frequencies.

By estimating a direction-dependent gain pattern in time and in frequency using the BTE microphones and applying this gain to the ITE microphone at high frequencies, there is no need for a correction filter in the hearing aid to correct for location mismatch, because the ITE microphone in or at the ear canal ensures that the localization cues will be maintained.

Furthermore, it may be possible to use different sampling frequencies and bandwidths for the BTE microphones compared to the microphone closer to or in the ear canal, and computational power can thus be saved. All automatics may as well be run with a lower sampling rate.

The direction-dependent time-frequency gain may be applied to the signal 302 from the ITE microphone for all frequencies or for the higher frequencies in order to enhance directionality, while the direction-dependent time-frequency gain for the low frequencies 304 may be applied to the directional signal 305 from the BTE microphones.

Furthermore, a hearing loss or hearing impairment may be accounted for in the hearing aid before transmitting the output signal to the user, and noise reduction and/or dynamic compression may also be provided in the hearing aid.

Figure 4A:
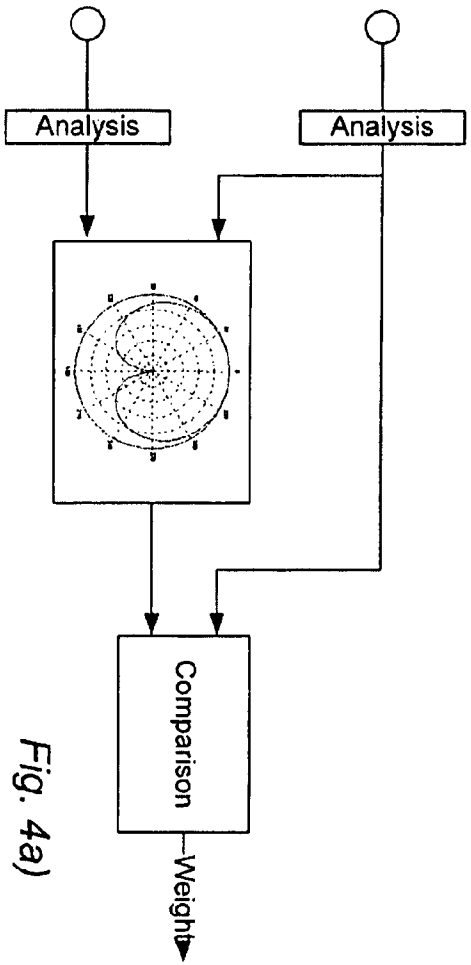
Fig. 4a) (PRIOR ART)
FIG. 4 shows possible ways of comparing beamformer patterns.
Figure 4B:
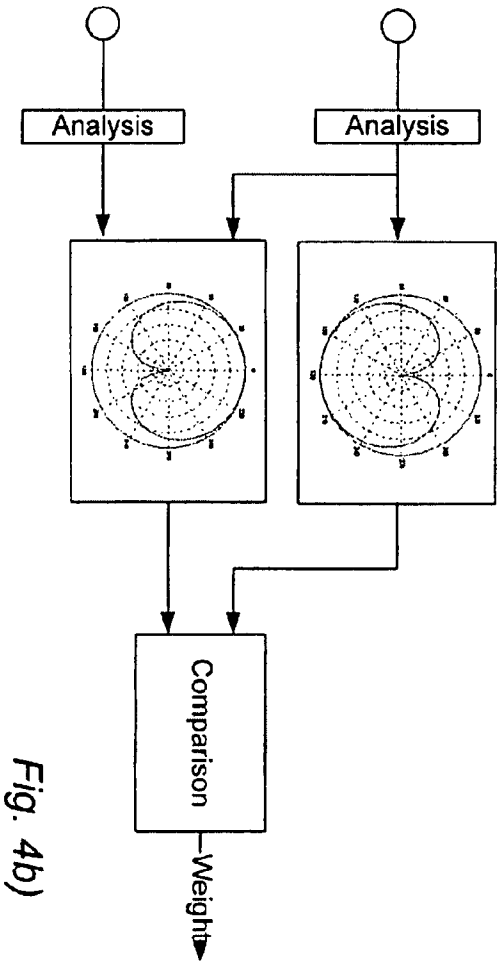

FIG. 4 shows possible ways of comparing beamformer patterns in order to obtain a weighting function of the BTE microphone signals. FIG. 4*a* shows a prior art method of comparing beamformer patterns, and FIG. 4*b* shows the method of the present invention on how to estimate the direction-dependent time-frequency gain by comparing beamformer patterns in the target and in the noise directions.

Beamforming may be combined with time-frequency masking in order to solve underdetermined sound mixtures. Time-frequency masking can be used to perform signal processing of the sound signals entering the microphones in a hearing aid. The time-frequency (TF) masking technique is based on the time-frequency (TF) representation of signals, which makes it possible to analyse and exploit the temporal and spectral properties of signals. By the TF representation of signals it is possible to identify and divide sound signals into desired and undesired sound signals. For a hearing aid user, the desired sound signal can be the sound signal coming from a speaking person located in front of the hearing aid user. Undesired sound signals may then be the sound signals coming from e.g. other speakers in the other directions, i.e. from the left, right and behind the hearing aid user. The sound received by the microphone(s) in the hearing aid will be a mixture of all the sound signals, both the desired entering frontally and the undesired coming from the sides and behind.

The microphone's directionality or polar pattern indicates the sensitivity of the microphone depending on which angles about its central axis, the sound is coming from.

The two BTE microphones, from which the beamformer patterns arise, may be omnidirectional microphones, and one of the microphones may be a front microphone in the direction of a target signal, and the other microphone may be a rear microphone in the direction of a noise/interferer signal.

The hearing aid user may, for example, want to focus on listening to one person speaking, i.e. the target signal, while there is a noise signal or a signal which interferes at the same time, i.e. the noise/interferer signal. By providing two omni-directional microphones in the BTE part of the hearing aid a directional signal may be provided, and the hearing aid user may turn his head in the direction from where the desired target signal is coming from. The front microphone in the hearing aid may pick up the desired audio signals from the target source, and the rear microphone in the hearing aid may pick up the undesired audio signals coming from the noise/interferer source, but the audio signals may be mixed, and the method of the present invention solves the problem of deciding what contribution to the incoming signal is made from which sources.

It may be assumed that two sound sources are present and separated in space.

From the beamformer patterns beamformer output functions of the target signal and the noise signal can be obtained. The distance between the two microphones will be smaller than the acoustic wavelength. To obtain a time-frequency (TF) representation of the output functions, some steps are applied to both the target and the noise signal: filtering through a k-point filterbank, squaring, low-pass filtering, and downsampling with a factor. Assuming that the target and noise signals are uncorrelated, the four steps result in two directional signals, both containing the TF representation of the target and the noise signal.

The direction-dependent TF mask can now be estimated using the two directional signals, i.e. the directional signal oriented in the direction of the target signal and the directional signal oriented in the direction of the noise signal. The TF mask is estimated by comparing the powers of the two directional signals and labelling each time-frequency (TF) coefficient as either belonging to the target signal or the noise/interferer signal. This means that if the power of the directional signal in the direction of the target signal exceeds the power of the directional signal in the direction of the noise signal for a time-frequency coefficient, then this time-frequency coefficient is labelled as belonging to the target signal. If the power the directional signal in the direction of the noise signal exceeds the power of the directional signal in the direction of the target signal, then this time-frequency coefficient is labelled as belonging to the noise/interferer signal, and this time-frequency coefficient will be removed.

The time-frequency (TF) coefficients are also known as TF units.

The direction-dependent time-frequency mask may be binary, and the direction-dependent time-frequency mask may be 1 for time-frequency coefficients belonging to the target signal, and 0 for time-frequency coefficients belonging to the noise signal.

When the direction-dependent time-frequency mask is binary, it is possible to perform and simplify the assignment of the time-frequency coefficients as either belonging to the target source or to a noise/interferer source. Hence, it allows a binary mask to be estimated, which will improve speech intelligibility for the hearing aid user.

When constructing the binary mask, a criterion for defining the amount of target and noise/interferer signals must be applied, which controls the number of retained and removed time-frequency coefficients. Decreasing the SNR value corresponds to increasing the amount of noise in the processed signal and vice versa. SNR may also be defined as local SNR criterion or applied local SNR criterion.

When estimating the direction-dependent time-frequency mask by comparing two directional signals with each other, the ratio between the two directional signals is maximized, since one of the directional signals in the direction of the target signal aims at cancelling the noise sources, and the other directional signal aims at cancelling out the target source, while the noise sources are maintained. Thus, the target and the noise/interferer signals are separated very well and by maximizing the ratio between the front and the rear aiming directional signals, it is easier to control the weighting-function, e.g. the sparsity of the weighting function, and thereby the sound localization and the speech intelligibility will be improved for the hearing aid user. A sparse weighting function may only contain few TF units that retain the target signal compared to the amount of noise TF units that cancel the noise.

Simulations using this method to estimate the direction-dependent time-frequency gain have shown that the binary TF mask will be of high quality as long as the target is located in front of the directional system, and the noise source is located behind the directional system.

Figure 5:
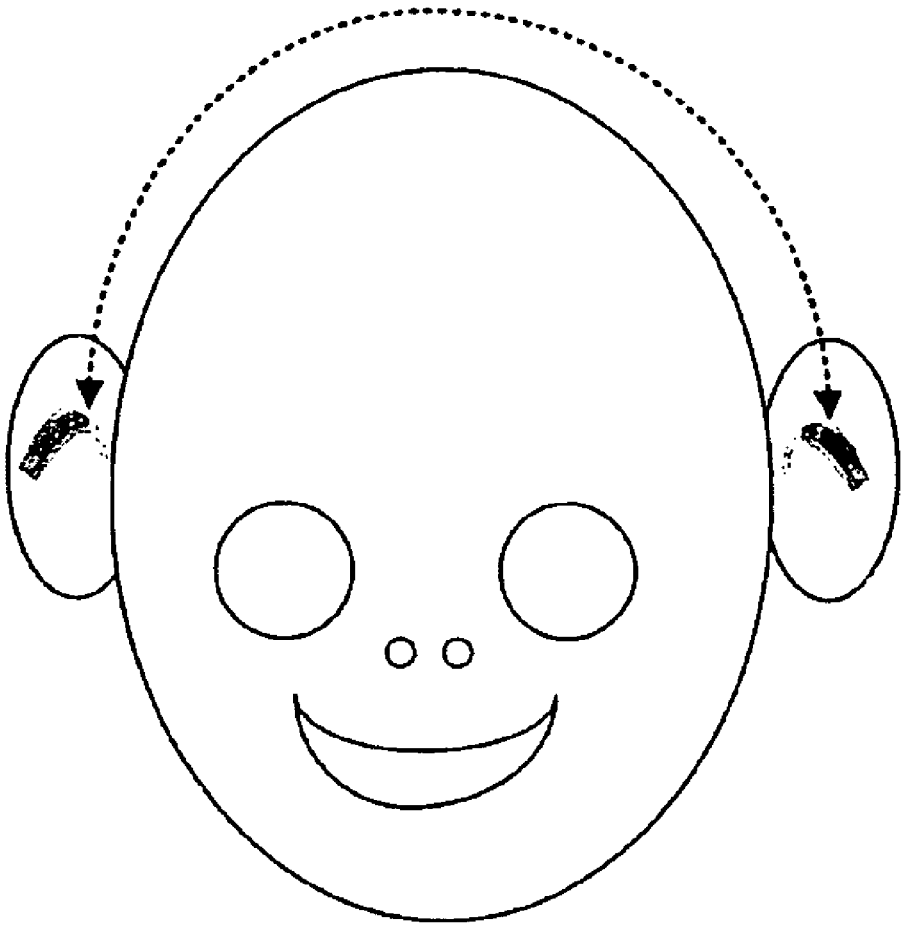
FIG. 5 shows transmission of time-frequency masks between two ears.

FIG. 5 shows a transmission of binary TF masks between the ears. The direction-dependent time-frequency gains may be transmitted and interchanged between two hearing aids, when the user is wearing one hearing aid on each ear. The direction-dependent time-frequency gains measured in the two hearing aids may differ from each other due to microphone noise, microphone mismatch, head-shadow effects etc, and a joint binary mask and estimation may therefore be more robust towards noise. So by interchanging the binary direction-dependent time-frequency mask between the two ears a better estimate of the binary gain may be obtained.

By synchronizing the binary gain pattern on the ears, the localization cues may not be not disturbed, as they would have been with different gain patterns on both ears.

Only the binary gain values, and not the entire functions, may be transmitted between the ears, which simplify the interchanging and synchronization of the direction-dependent time-frequency gains.

A frequent frame-by-frame transmission may be required when merging transmissions of binary TF masks between the ears due to possible transmission delay. The joint mask may either not be completely time-aligned with the audio signal to which it is applied, or the signal have to be delayed in order to become time-aligned.

The transmission of TF masks between the ears may be performed by means of a wireless connection, such as radio frequency communication, microwave communication or infrared communication or by means of a small wire connection between the hearing aids.

FIG. 6 shows merging of parallel comparisons between different beamformers.

Figure 6A:
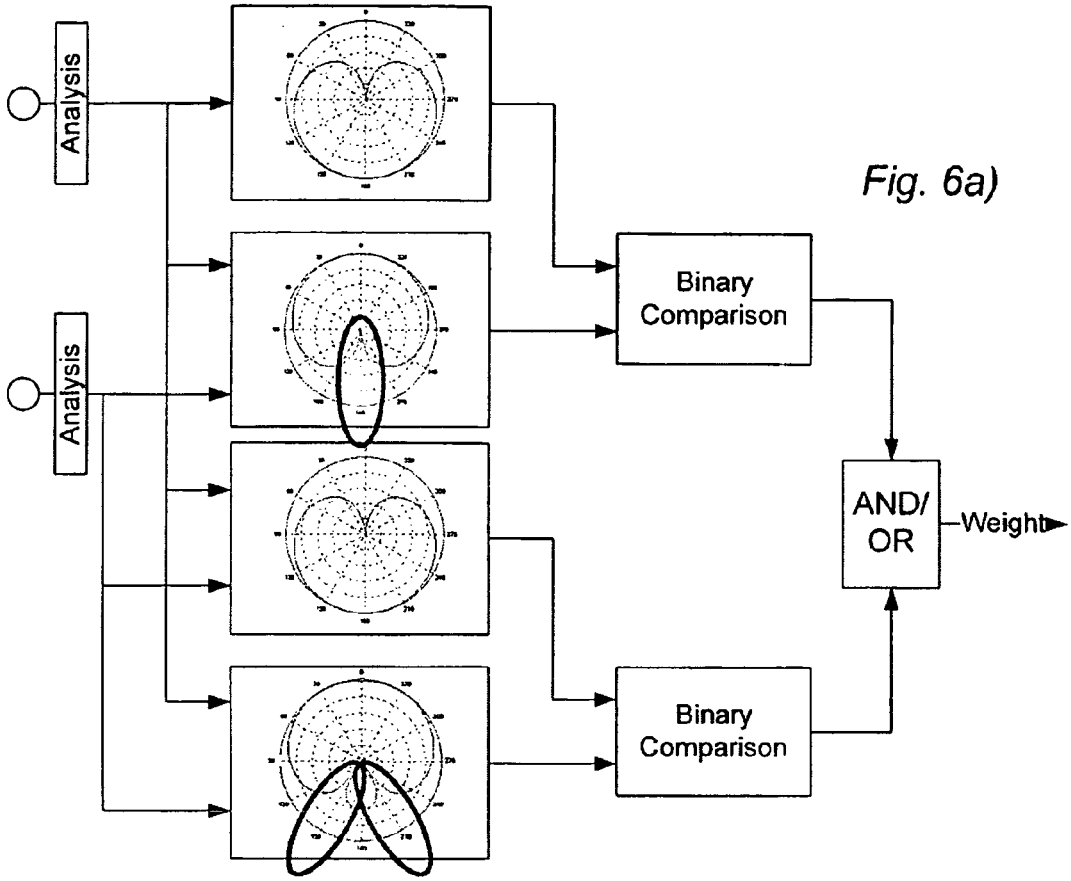
FIG. 6 shows merging of parallel comparisons between different beamformers.

FIG. 6*a* shows the beamformers patterns to compare. When making several comparisons in parallel instead of just one comparison, a more robust estimate of the binary mask will be made, since each comparison has a direction in which the estimate is more robust than in other directions. Towards the directions with the biggest difference between the front and the rear signals the binary gain estimates are very good and robust.

Figure 6B:
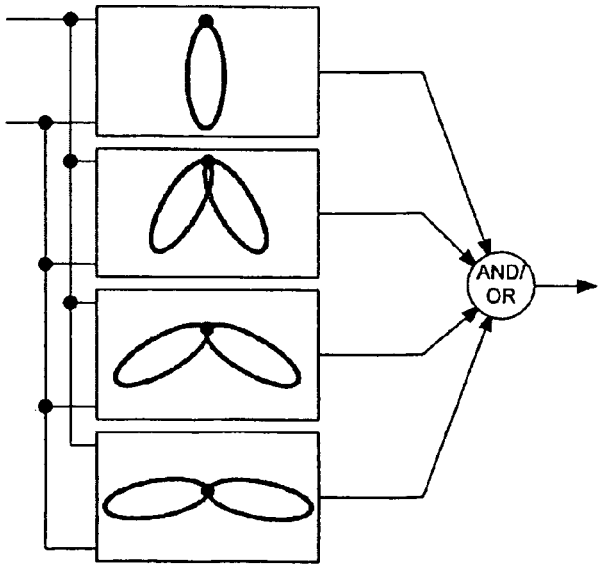

FIG. 6*b* shows how merging may be performed by applying AND/OR functions between the different direction-dependent time-frequency gains. By applying an OR or an AND function to the different estimates, an overall more robust binary gain estimate can be obtained. Alternatively, other suitable functions such as psychoacoustic functions may be applied. By having different beamformer patterns as seen in FIG. 6*a* and FIG. 6*b* it is possible to disregard or turn off certain sources, depending on the signals.

Figure 7A:
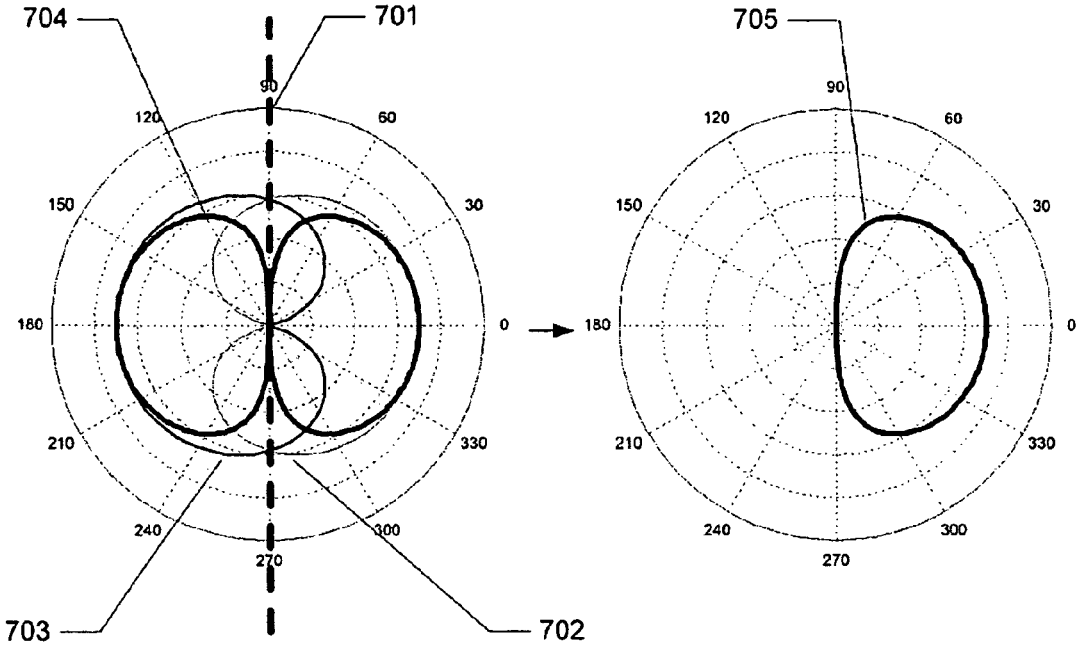
FIG. 7 shows examples of the application of an estimated time-frequency gain to a directional signal.
Figure 7B:
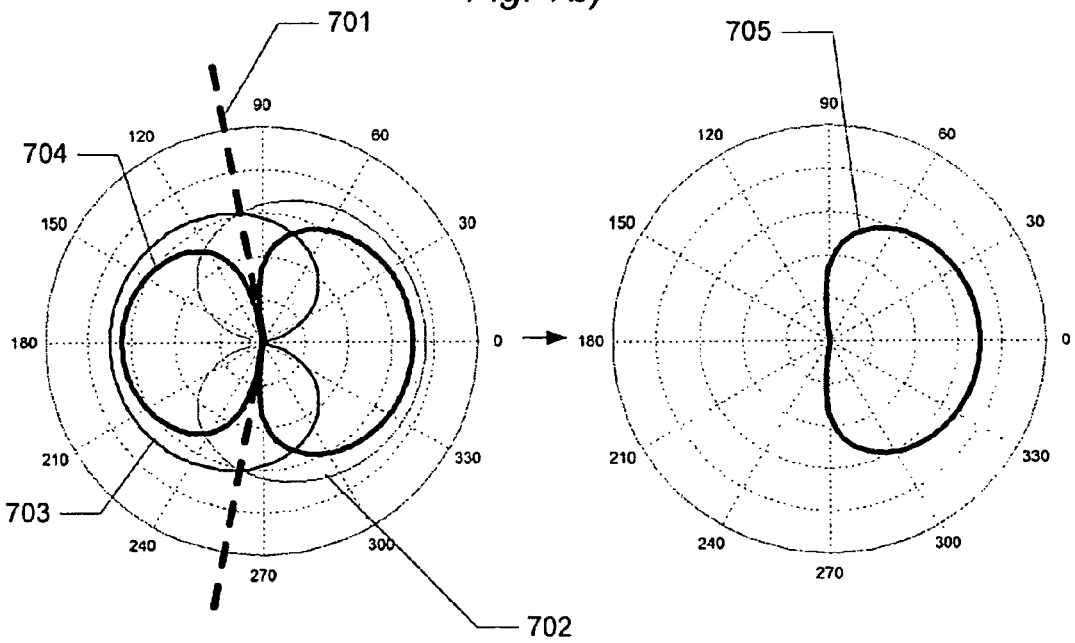

FIG. 7*a*) and FIG. 7*b*) each show an example of the application of an estimated time-frequency gain to a directional signal, where the directional signal aims at attenuating signals in the direction of the decision boundary between the front-aiming and the-rear-aiming beamformer. The direction of the decision boundary is where the ratio between the transfer function of the front beamformer and the transfer function of the rear beamformer equals the decision threshold. The first polar diagram in FIGS. 7*a*) and 7*b*) shows the decision threshold 701, the front-aiming beam pattern 702, the rear-aiming beam pattern 703 and the beam pattern with nulls aiming towards the weak decision 704. The null direction of the beam former has the same direction as the binary decision threshold. In the directions, where the decision boundary between the two directional signals is located, the time-frequency mask estimate is based on a weak decision. In order to minimize the effect of weak decisions, the resulting time-frequency gain is multiplied to a directional signal, which aims at attenuating signals in the direction of the weak decision. The second polar diagram in FIGS. 7*a*) and 7*b*) shows the resulting sensitivity pattern 705 after the time-frequency gain is applied to the directional signal.

As an alternative to performing the time-frequency mask estimation in the one or more hearing aids as described above, an external device arranged externally in relation to the one or more hearing aids may perform the estimation of one or more of the time-frequency masks, and the one or more time-frequency masks may then be transmitted to the one or more hearing aids. An advantage of using an external device to estimate the time-frequency mask is that only a single microphone may be required in each hearing aid, and this may save space in the hearing aids. The external device may be a hand-held device, and the connection between the external device and the one or more hearing aids may be a wireless connection or a connection by means of a wire.

Although some embodiments have been described and shown in detail, the invention is not restricted to them, but may also be embodied in other ways within the scope of the subject matter defined in the following claims. In particular, it is to be understood that other embodiments may be utilised and structural and functional modifications may be made without departing from the scope of the present invention.

In device claims enumerating several means, several of these means can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A method of generating an audible signal in a hearing aid by estimating a weighting function of received audio signals, the hearing aid is adapted to be worn by a user; the method comprises the steps of:

estimating a directional signal by estimating a weighted sum of two or more microphone signals from two or more microphones, where a first microphone of the two or more microphones is a front microphone, and where a second microphone of the two or more microphones is a rear microphone;

estimating a direction-dependent time-frequency gain, and synthesizing an output signal;

wherein estimating the direction-dependent time-frequency gain comprises:

obtaining at least two directional signals each containing a time-frequency representation of a target signal and a noise signal; and where a first of the directional signals is defined as a front aiming signal, and where a second of the directional signals is defined as a rear aiming signal;

using the time-frequency representation of the target signal and the noise signal to estimate a time-frequency mask; and using the estimated time-frequency mask to estimate the direction-dependent time-frequency gain.

2. A method according to claim 1, wherein using the time-frequency representation of the target signal and the noise signal to estimate a time-frequency mask comprises comparing the at least two directional signals with each other for each time-frequency coefficient in the time-frequency representation.

3. A method according to claim 2, wherein using the estimated time-frequency mask to estimate the direction-dependent time-frequency gain comprises determining, based on said comparison, for each time-frequency coefficient, whether the time-frequency coefficient is related to the target signal or the noise signal.

4. A method according to claim 1, further comprising:

obtaining an envelope for each time-frequency representation of the at least two directional signals; and using the envelope of the time-frequency representation of the target signal and the noise signal to estimate the time-frequency mask.

5. A method according to claim 4, wherein using the envelope of the time-frequency representation of the target signal and the noise signal to estimate a time-frequency mask comprises comparing the two envelopes of the directional signals with each other for each time-frequency envelope sample value.

6. A method according to claim 4, wherein determining the envelope of a time-frequency representation comprises:

raising the absolute magnitude value of each time-frequency coefficient to the p'th power, where p is a predetermined value;

filtering the power raised absolute magnitude value over time by using a predetermined low pass filter.

7. A method according to claim 3, wherein determining for each time-frequency coefficient whether the time-frequency coefficient is related to the target signal or the noise signal comprises:

determining whether the ratio of the envelope signal of the time-frequency representation of the directional signal in the direction of the target signal to the envelope of the directional signal in the direction of the noise signal exceeds a predetermined threshold; and assigning the time-frequency coefficient as relating to the target signal if the ratio of the envelope signal of the directional signal in the direction of the target signal to the envelope of the directional signal in the direction of the noise signal exceeds a predetermined threshold.

assigning the time-frequency coefficient as relating to the noise signal if the ratio of the envelope signal of the directional signal in the direction of the target signal to the envelope of the directional signal in the direction of the noise signal does not exceeds a predetermined threshold.

8. A method according to claim 1, wherein the time-frequency mask is a binary mask, where the time-frequency mask is 1 for time-frequency coefficients belonging to the target signal, and 0 for time-frequency coefficients belonging to the noise signal.

9. A method according to claim 1, wherein the method further comprises:

multiplying the estimated direction-dependent time-frequency gain to the directional signal, and processing and transmitting the output signal to an output transducer in the hearing aid at low frequencies.

10. A method according to claim 1, wherein the method further comprises:

multiplying the estimated direction-dependent time-frequency gain to the signals from the two or more of the microphones, and processing and transmitting the output signals to an output transducer in the hearing aid at low frequencies.

11. A method according to claim 1, wherein the method further comprises applying the estimated direction-dependent time-frequency gain to a signal from a third microphone, the third microphone being arranged in or near an ear canal of the user, and processing and transmitting the output signal to an output transducer in the hearing aid at high frequencies.

12. A method according to claim 1, wherein the method further comprises applying the estimated direction-dependent time-frequency gain to one or more of the microphone signals from one or more of the microphones, and processing and transmitting the output signal to an output transducer in the hearing aid.

13. A method according to claim 1, wherein the directional signals are provided by means of at least two beamformers, where at least one of the beamformers is chosen from the group consisting of:

fixed beamformers adaptive beamformers.

14. A method according to claim 1, wherein the estimated time-frequency gain is applied to a directional signal, which aims at attenuating signals in the direction of the decision boundary between a front-aiming and a rear-aiming beamformer.

15. A method according to claim 1, wherein the method further comprises transmitting and interchanging the time-frequency masks between two hearing aids, when the user is wearing one hearing aid on each ear.

16. A method according to claim 1, wherein the method further comprises performing comparisons of the difference between the target signal and the noise signal and merging the parallel comparisons between sets of different beam patterns.

17. A method according to claim 16, wherein the merging comprises applying functions between the different time-frequency masks, at least one of the functions is chosen from the group consisting of:

AND functions

OR functions psychoacoustic models.

18. A hearing aid adapted to be worn by a user, comprising:

two or more microphones, a first microphone of the two or more microphones being a front microphone and a second microphone of the two or more microphones being a rear microphone, a first module housing at least one of the two or more microphones;

a signal processing unit; and one or more output transducers configured to output a synthesized output signal, wherein the signal processing unit is configured to obtain at least two directional signals, a first of the at least two directional signals being a front aiming signal and a second of the at least two directional signals being a rear aiming signal, each of the at least two directional signals containing a time-frequency representation of a target signal and a noise signal, estimate a time-frequency mask based on the time-frequency representation of the target signal and the noise signal in each of the at least two directional signals, estimate a direction-dependent time-frequency gain based on the estimated time-frequency mask, and synthesize an output signal to be output by the one or more output transducers based on the direction-dependent time-frequency gain.

19. A hearing aid according to claim 18, wherein said first module is adapted to be arranged behind an ear of the user.

20. A hearing aid according to claim 18, wherein said first module is adapted to be arranged in or near an ear canal of the user.

21. A hearing aid according to claim 18, further comprising:

a second module comprising at least one of the two or more microphones.

22. A hearing aid according to claim 21, wherein said first module is adapted to be arranged behind an ear of the user, and said second module is adapted to be arranged in or near an ear canal of the user.

23. A hearing aid according to claim 21, wherein said one or more microphones comprised in said second module is an omnidirectional microphone.

24. A hearing aid according to claim 21, wherein said one or more microphones comprised in said second module is a directional microphone.

25. A hearing aid according to claim 22, wherein said first module further comprises said signal processing unit.

26. A hearing aid according to claim 22, wherein said first module further comprises a battery.

27. A hearing aid according to claim 22, wherein said second module adapted to be arranged in or near the ear canal further comprises said one or more output transducers.

28. A hearing aid according to claim 22, wherein said second module adapted to be arranged in or near the ear canal is an ear mould.

29. A hearing aid according to claim 22, wherein said second module adapted to be arranged in or near the ear canal is a micro mould.

30. A hearing aid according to claim 22, wherein said second module adapted to be arranged in or near the ear canal is an ear insert.

31. A hearing aid according to claim 22, wherein said second module adapted to be arranged in or near the ear canal is a plastic insert.

32. A hearing aid according to claim 22, wherein said second module adapted to be arranged in or near the ear canal is shaped relative to the user's ear.

33. A hearing aid according to claim 22, wherein said second module adapted to be arranged in or near the ear canal comprises a soft material.

34. A hearing aid according to claim 33, wherein said soft material has a shape as a dome.

35. A hearing aid according to claim 22, wherein the first module adapted to be arranged in or near the ear canal and the second module adapted to be arranged behind the ear are connected by means of a wire.

36. A hearing aid according to claim 22, wherein the first module adapted to be arranged behind the ear is a behind-the-ear module.

37. A hearing aid according to claim 22, wherein the second module adapted to be arranged in or near the ear canal is an in-the-ear module.

38. A hearing aid according to claim 22, further comprising:

a communications interface configured to communicate with a second hearing aid arranged at another ear of the user.

39. A device adapted to be arranged externally in relation to one or more hearing aids, where the device comprises processing means adapted to perform the method according to claim 1, and wherein the one or more estimated time-frequency masks are adapted to be transmitted to the one or more hearing aids.

40. A tangible computer-readable medium encoded with instructions for causing a data processing system to perform a method, when said instructions are executed on the data processing system, the method comprising:

estimating a directional signal b estimating a weighted sum of two or more microphone signals from two or more microphones, where a first microphone of the two or more microphones is a front microphone, and where a second microphone of the two or more microphones is a rear microphone;

estimating a direction-dependent time-frequency gain, and synthesizing an output signal;

wherein estimating the direction-dependent time-frequency gain comprises:

obtaining at least two directional signals each containing a time-frequency representation of a target signal and a noise signal; and where a first of the directional signals is defined as a front aiming signal, and where a second of the directional signals is defined as a rear aiming signal;

using the time-frequency representation of the target signal and the noise signal to estimate a time-frequency mask; and using the estimated time-frequency mask to estimate the direction-dependent time-frequency gain.

41. A data processing system comprising a processor and program code means for causing the processor to perform the method of claim 1.

* * * * *